US005553559A

United States Patent [19]

Inoue et al.

[11] Patent Number: 5,553,559

[45] Date of Patent: Sep. 10, 1996

[54] SEWING MACHINE AND A RECORDING MEDIUM FOR USE IN COMBINATION WITH THE SAME

[75] Inventors: Tomo Inoue; Takashi Hirata, both of Nagoya, Japan

[73] Assignee: Brother Kogyo Kabushiki Kaisha, Nagoya, Japan

[21] Appl. No.: 199,805

[22] Filed: Feb. 22, 1994

[30] Foreign Application Priority Data

May 14, 1993 [JP] Japan ..... 5-113212

[51] Int. Cl.[6] ..... D05B 21/00

[52] U.S. Cl. ..... 112/102.5; 364/470.09

[58] Field of Search ..... 112/121.12, 103, 112/121.25, 453, 454, 121.11, 102.5, 470.06, 454; 364/470

[56] References Cited

U.S. PATENT DOCUMENTS 2,544,757 3/1951 Isaacson ..... 112/121.25
4,554,880 11/1985 Kongoh ..... 112/454
4,557,207 12/1985 Turner et al. ..... 112/454 X
5,021,965 6/1991 Olbrich ..... 112/121.12 X
5,231,941 8/1993 Wakayama ..... 112/121.12

FOREIGN PATENT DOCUMENTS 0430891 2/1992 Japan ..... 112/103
4-2388 7/1992 Japan .

*Primary Examiner*—Peter Nerbun
*Attorney, Agent, or Firm*—Nikaido, Marmelstein, Murray & Oram LLP

[57] ABSTRACT

Stitching data including reference point data specifying a reference point in an embroidery pattern is used when embroidering the pattern included in one or more patterns which are formed on a workpiece. A mark indicating the reference point is stitched on the workpiece or the location of the reference point is stored in a storage memory. The mark indicating the reference point or the storage of the location of the reference point enables the efficient, accurate determination of the positions of the one or more patterns on the workpiece being embroidered.

26 Claims, 6 Drawing Sheets

SEWING MACHINE AND A RECORDING MEDIUM FOR USE IN COMBINATION WITH THE SAME

BACKGROUND OF THE INVENTION

1. Field of the Invention

The present invention relates to a sewing machine and a recording medium for use in combination with the sewing machine.

2. Description of the Related Art

A conventional embroidering machine will be described hereinafter referring to FIG. 1. As shown in FIG. 1, this machine has a bed 10, a standard 12 rising from the right-hand end of the bed 10, an arm 14 horizontally extending over the bed 10 from the upper end of the standard 12, and a sewing head 16 formed on the extremity of the arm 14.

A liquid crystal display unit 20 of a dot matrix type is attached to the front wall of the arm 14. Pattern selection keys, and a selected pattern and stitching position changing key are displayed on the screen of the display unit 20. An analog transparent electrode switch plate 22 is put on the front surface of the display 20. Keys displayed on the screen of the display unit 20 can be operated. Operating keys 24 for selecting types of patterns are arranged on the front wall of the arm 14 in a region on the right-hand side of the display unit 20.

A start-stop switch 26 for starting and stopping stitching operation is attached to the front wall of the sewing head 16. A needle bar 30 is supported for vertical reciprocation on the sewing head 16 so as to project downward from the lower end of the sewing head 16, and a needle 32 is fixed to the lower end of the needle bar 30. A presser bar 34 is supported for movement between an upper position and a lower position on the sewing head 16 in parallel to the needle bar 30, and a presser foot 36 is fixed to the lower end of the presser bar 34.

An embroidering unit 37 is mounted on the bed 10. The embroidering unit 37 has an embroidery frame moving mechanism 39 mounted on the upper wall thereof. The embroidery frame moving mechanism 39 moves an embroidery frame 38 holding the workpiece longitudinally and laterally relative to the needle 32.

Each of the embroidery patterns to be stitched by the embroidering machine has a reference point 40 with respect to which the embroidery pattern is stitched, i.e., the position of each stitch in the embroidery pattern is defined relative to the reference point 40. The reference point 40 of, for example, a pattern as shown in FIG. 2 may be at the intersection point of the longitudinal and lateral center lines, i.e., alternate long and short dash lines in FIG. 2, of a rectangular pattern frame 44 circumscribing the pattern. The rectangular pattern frame 44 circumscribing the embroidery pattern is preferably a rectangle (which may be a square) which is of the minimum area required to circumscribe the embroidery pattern. The reference point can be located at any desired location relative to the embroidery pattern, e.g., in some instances, it might be desired to have the reference point 40 displaced from the center of the pattern 42 or even outside the oval shape of the pattern 42. When the push button of the start-stop switch 26 is pushed, the pattern 42 is embroidered so that the reference point 40 thereof is directly below the position where the needle 32 was located at a time (1) before the first stitch in the stitching pattern was stitched, and (2) when the push button was operated to start stitching the stitching pattern. Thus, with regard to the stitching pattern shown in FIG. 2, the needle 32 is located above the reference point 40 before the push button is pushed and before the first stitch in the stitching pattern is stitched.

Referring to FIG. 3 showing the embroidery frame 38 and the embroidery frame moving mechanism 39 of the embroidering unit 37 in an enlarged view, the embroidery frame 38 has a 10 cm ×10 cm square effective embroidering area 52. A center position 50 is at the center of the effective embroidering area 52. When the main switch of the embroidering machine is closed to connect the embroidering machine to a power source, the embroidery frame 38 is positioned so that the center position 50 is directly below the needle 32.

Upon the completion of the embroidering of a pattern, the embroidering machine stops with the needle 32 at the end of the embroidered pattern or the thread is cut, and the embroidery frame 38 is returned automatically to its reference position relative to the needle 32, such that the reference point 40 of the embroidery pattern is again directly below the needle 32.

When successively embroidering patterns by using a ROM card storing pattern data, the embroidering machine stops with the needle 32 at the end of the embroidered pattern. If the embroidering machine is started after cutting the thread without changing the position of the needle 32 to embroider the next pattern, the next pattern is embroidered over the previously embroidered pattern with its .reference point on that of the previously embroidered pattern. The pattern data is prepared so that the patterns embroidered in successive embroidering cycles are superposed properly.

As shown in FIGS. 4A and 4B, the position of the pattern frame 44 in the effective embroidering area 52 of the embroidery frame 38 is determined by operating embroidery frame movement keys displayed on the screen of the display unit 20. For example, the pattern frame 44 positioned at the center of the effective embroidering area 52 as shown in FIG. 4A can be shifted to a lower position in the effective embroidering area 52 shown in FIG. 4B by operating the down key 60, i.e., one of the embroidery frame movement keys, such that the reference point 40 of the embroidery pattern differs from the center position 50. Thus, operation of the embroidery frame movement keys moves the location of the reference point 40 with respect to which the embroidery pattern is stitched. When the push button of the start-stop switch 26 is pushed with the pattern frame 44 positioned as shown in FIG. 4B, a selected pattern is embroidered in the pattern frame 44 positioned at the lower position shown in FIG. 4B. Thus, the position of the pattern frame 44 in the effective embroidering area 52 can be optionally determined by manual operation.

SUMMARY OF THE INVENTION

The following problem arises when different ROM cards are used for successively embroidering a plurality of patterns. First, the pattern frame 44 is positioned at the lower position shown in FIG. 4B by operating the down key 60, and then, a pattern stored in a ROM card A is embroidered at the lower position. Subsequently, the ROM card A is replaced with a ROM card B. When the ROM card A is replaced with the ROM card B, the embroidery machine is initialized, in which the embroidery machine is disconnected from the power source, and then, the embroidery machine is connected again to the power source after the ROM card B has been inserted in the embroidery machine and the center position 50 is located directly below the needle 32. When it is desired to embroider the pattern stored in the ROM card B, following the embroidered pattern stored in the ROM card A, the reference point of the previously embroidered pattern is measured with a ruler, and the reference point of the same is marked on the workpiece. Then, the embroidery frame 38 is moved by operating embroidery frame movement keys to locate the mark directly below the needle 32.

This procedure for locating the embroidery frame 38 requires troublesome operations, the reference point can be measured incorrectly and, consequently, the pattern stored in the ROM card B possibly might be embroidered at a position dislocated from a correct position.

A similar problem arises in the following scenario. It is sometimes desirable to remove the workpiece from the sewing machine during the stitching of an embroidery pattern and later reinsert the workpiece and complete the embroidery pattern. In such instances, the reference point of the partially completed embroidery pattern is measured with a ruler (either before or after reinserting the workpiece), and the reference point of the same is marked on the workpiece. Then, after the workpiece has been reinserted, the embroidery frame 38 is moved by operating the embroidery frame movement keys to locate the mark directly below the needle 32. The embroidery pattern is then completed. Likewise, it is sometimes desirable to remove the workpiece from the sewing machine between successive embroidery patterns and later reinsert the workpiece and stitch the next embroidery pattern. In such instances, the reference point of the completed embroidery pattern is measured with a ruler (either before or after reinserting the workpiece), and the reference point of the same is marked on the workpiece. Then, after the workpiece has been reinserted, the embroidery frame 38 is moved by operating the embroidery frame movement keys to locate the mark directly below the needle 32. The next embroidery pattern is then completed.

This procedure for locating the embroidery frame 38 requires troublesome operations, the reference point can be measured incorrectly and, consequently, the stitching after reinsertion of the workpiece may be possibly embroidered relative to a reference point which is not in the correct position.

A similar problem also arises in the following scenario. Sometimes, the power to the machine is switched off after an embroidery pattern has been partially completed, and later, the power to the machine is switched back on, without changing the ROM card, and the embroidery pattern is then completed. In such instances, the reference point of the partially completed embroidery pattern is measured with a ruler (either before or after switching the power to the machine back on), and the reference point of the same is marked on the workpiece. Then, after the power to the machine is switched back on, the embroidery frame 38 is moved by operating the embroidery frame movement keys to locate the mark directly below the needle 32. The embroidery pattern is then completed.

This procedure for locating the embroidery frame 38 also requires troublesome operations, because the reference point can be measured incorrectly and, consequently, the stitching after switching the power to the machine back on possibly might be embroidered relative to a reference point which is not in the correct position.

Accordingly, it is an object of the present invention to provide a sewing machine that enables efficient and correct operations for positioning a series of patterns.

A sewing machine in one aspect of the present invention is provided with a controller which controls a stitcher and a workpiece mover (which moves the workpiece relative to the stitcher) so that a mark indicating the reference point of a pattern can be correctly marked on the workpiece.

A recording medium to be used in combination with the sewing machine of the present invention stores control data to be used by the controller to control the stitcher and the workpiece mover.

The controller of the sewing machine of the present invention controls the stitcher and the workpiece mover to mark the mark indicating the reference point of a pattern correctly on the workpiece.

The controller controls the stitcher and the workpiece mover according to the control data stored in the recording medium to mark the mark indicating the reference point of a pattern correctly on the workpiece.

In another aspect of the present invention, there is provided a sewing machine which includes a storage memory which stores the location of one or more reference points.

Thus, the present invention marks the mark indicating the reference point of a pattern correctly on the workpiece to facilitate the determination of the position of a pattern to be stitched and enables quick positioning of the workpiece.

Furthermore, the present invention enhances the efficiency of workpiece positioning work and facilitates the operation of the sewing machine.

Still further, the present invention enables the accurate positioning of a pattern on the workpiece.

BRIEF DESCRIPTION OF THE DRAWINGS

A preferred embodiment of the present invention will be described in detail with reference to the following drawings, wherein.

DESCRIPTION OF THE PREFERRED EMBODIMENTS

Figure 1:
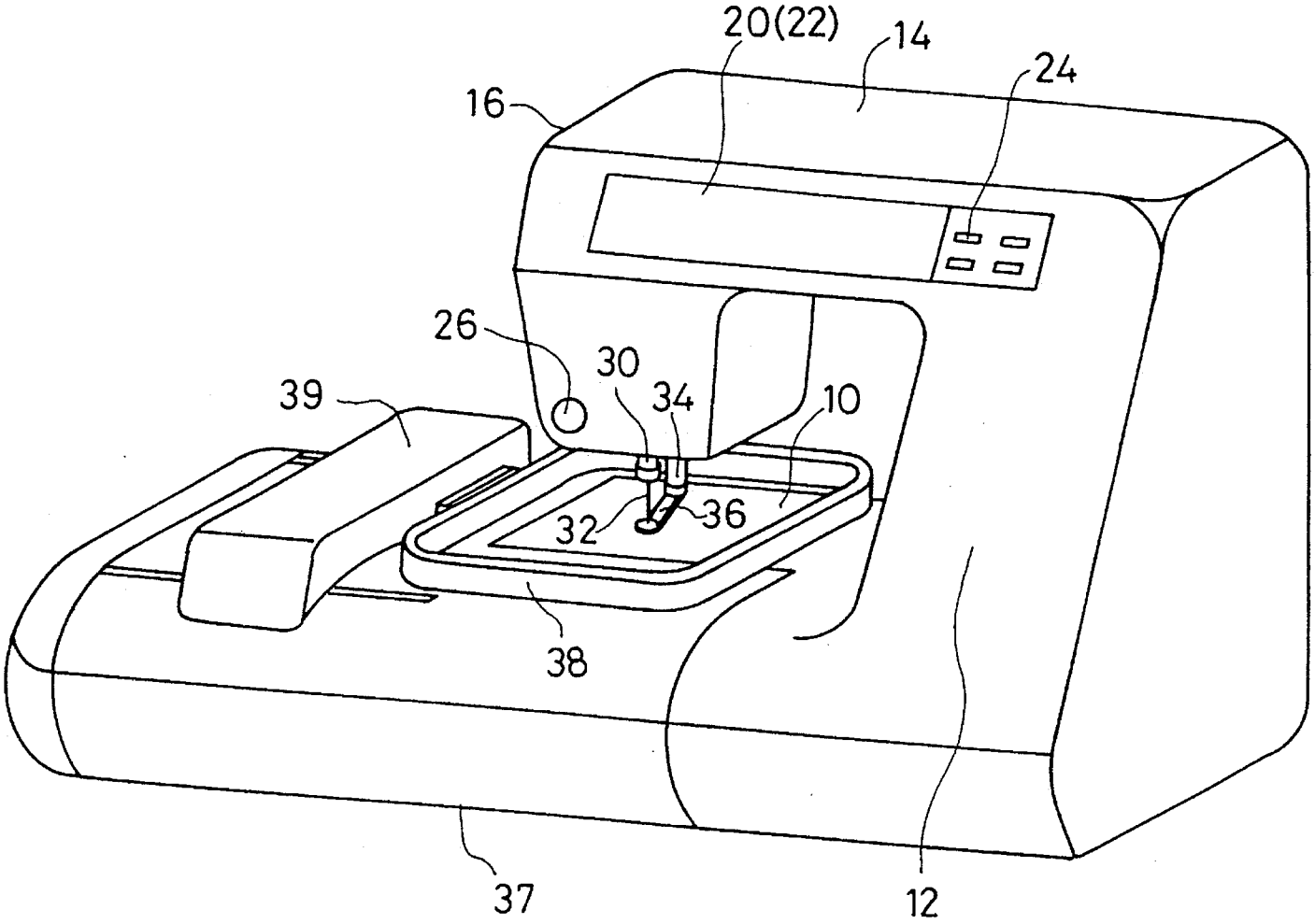
FIG. 1 is a perspective view of an embroidering machine, which is similar in mechanical configuration to a sewing machine in accordance with the present invention.

A sewing machine in a preferred embodiment according to the present invention will be described hereinafter with reference to the accompanying drawings. The mechanical configuration of the sewing machine of the present invention is the same as that of the conventional embroidering machine previously described with reference to FIG. 1 and hence the description thereof is not needed to describe the present invention. The stitcher and the workpiece mover can comprise any apparatus which are capable of performing stitching and moving a workpiece as described herein. For example, a stitcher typically comprises a needle which reciprocates up and down (and which can swing laterally for particular stitching patterns) and a loop taker which cooperates with the needle to form stitches, as is well known in the stitching art.

Figure 6:
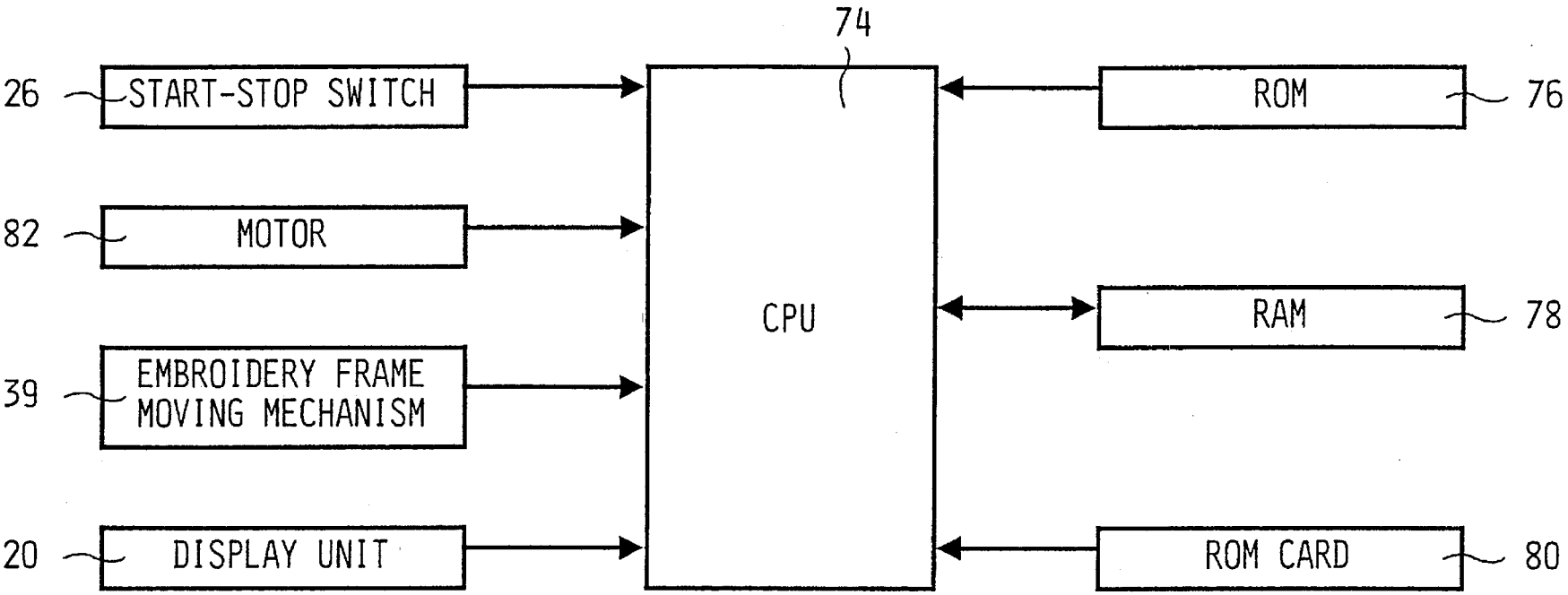
FIG. 6 is a block diagram of an electrical system included in a sewing machine embodying the present invention.

Referring to FIG. 6 showing the electrical configuration of the sewing machine embodying the present invention, a CPU 74 for controlling the general operations of the embroidering machine is capable of controlling a display unit 20. A ROM 76 and a RAM 78, i.e., internal storage devices, are connected to the CPU 74. The CPU 74 reads data from a ROM card 80, i.e., an external storage device, and writes the data in the RAM 78. The CPU 74 is capable of controlling a motor 82 for driving a needle operating mechanism for vertically reciprocating a needle 32, and an embroidery frame moving mechanism 39 for moving an embroidery frame 38 relative to the needle 32. A start-stop switch 26 is connected to the CPU 74.

The RAM 78 has storage areas for temporarily storing the data read from the ROM card 80 and data to be processed during the execution of control programs.

The ROM card 80 has storage areas storing pattern data representing a pattern, and displaying data for displaying the pattern on the display unit 20. The location of each stitch in the pattern is defined in relation to the position of the workpiece mover when the stitching operation is initiated, i.e., the reference position.

The ROM 76 has storage areas storing a known set area subroutine for calculating a stitching operation starting position and an effective embroidering area. The operation of the sewing machine is controlled so that an embroidery frame 38 will not interfere with the needle 32 and the presser foot 36.

Figure 7A:
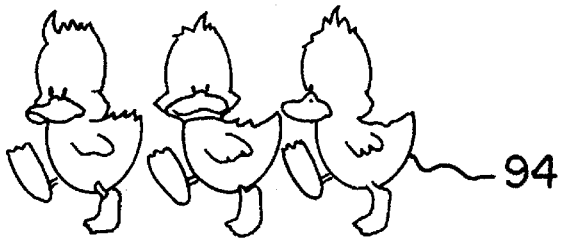
FIGS. 7A, 7B and 7C are illustrations of a pictorial pattern, a character pattern and a framing pattern, respectively, to be embroidered by the sewing machine embodying the present invention.
Figure 7B:
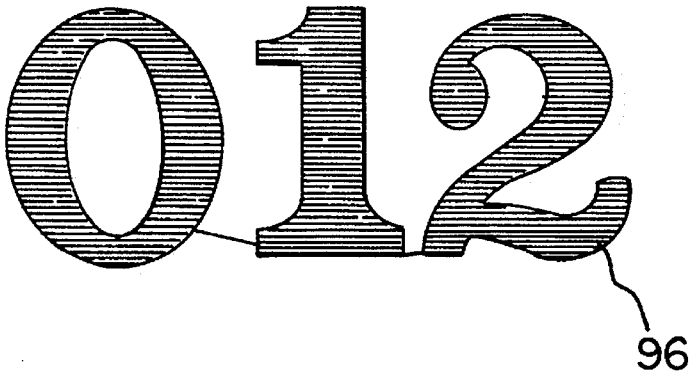
Figure 7C:
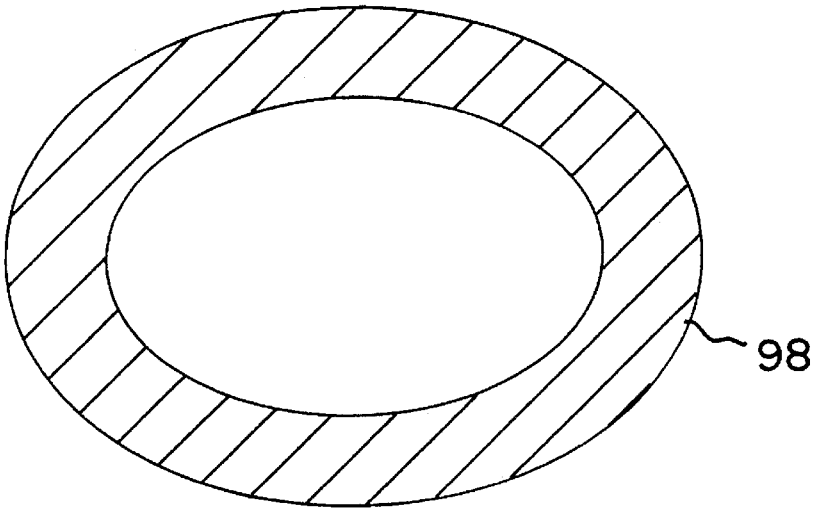

Next, patterns to be embroidered by the sewing machine constituted as explained above will be described hereinafter. Patterns are classified roughly into three kinds of patterns, namely, pictorial patterns including a pictorial pattern 94 as shown in FIG. 7A, character patterns including a character pattern 96 as shown in FIG. 7B and framing patterns including a framing pattern 98 as shown in FIG. 7C. Generally, the framing patterns are not formed individually, but the same are used for forming a composite pattern in combination with the pictorial pattern 94 or the character pattern 96.

A sewing machine in one aspect of the present invention is provided with a controller which controls a stitcher and a workpiece mover (which moves the workpiece relative to the stitcher) so that a mark indicating the reference point of a pattern can be correctly marked on the workpiece.

Figure 2:
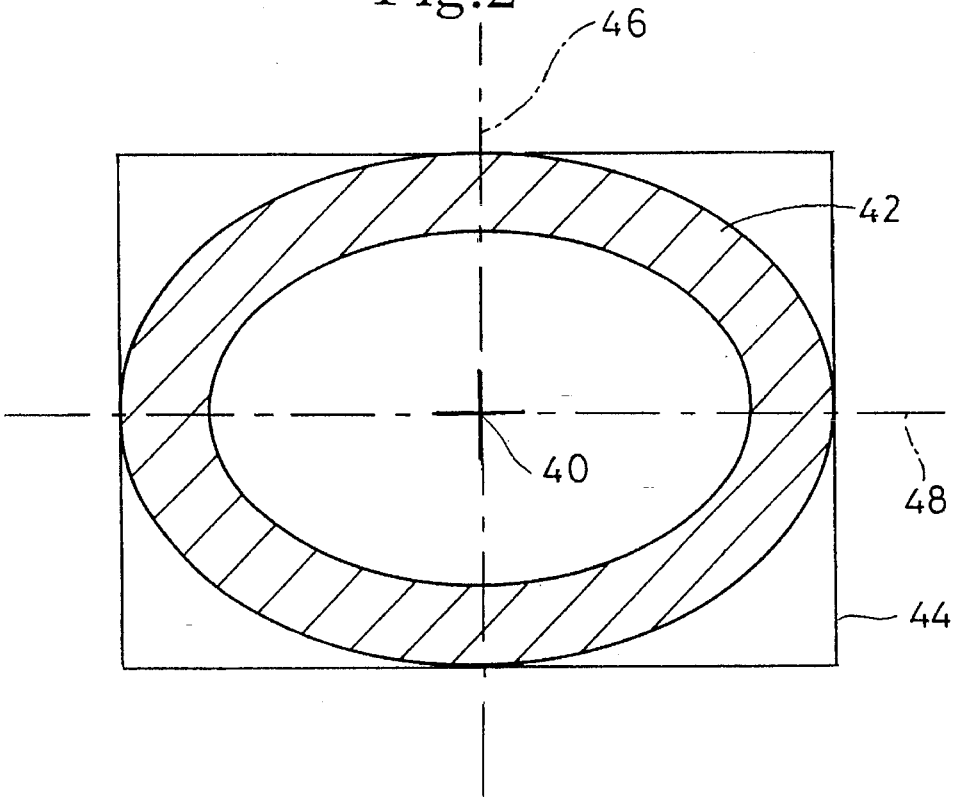
FIG. 2 is a diagrammatic view of assistance in explaining the reference point of a pattern.
Figure 3:
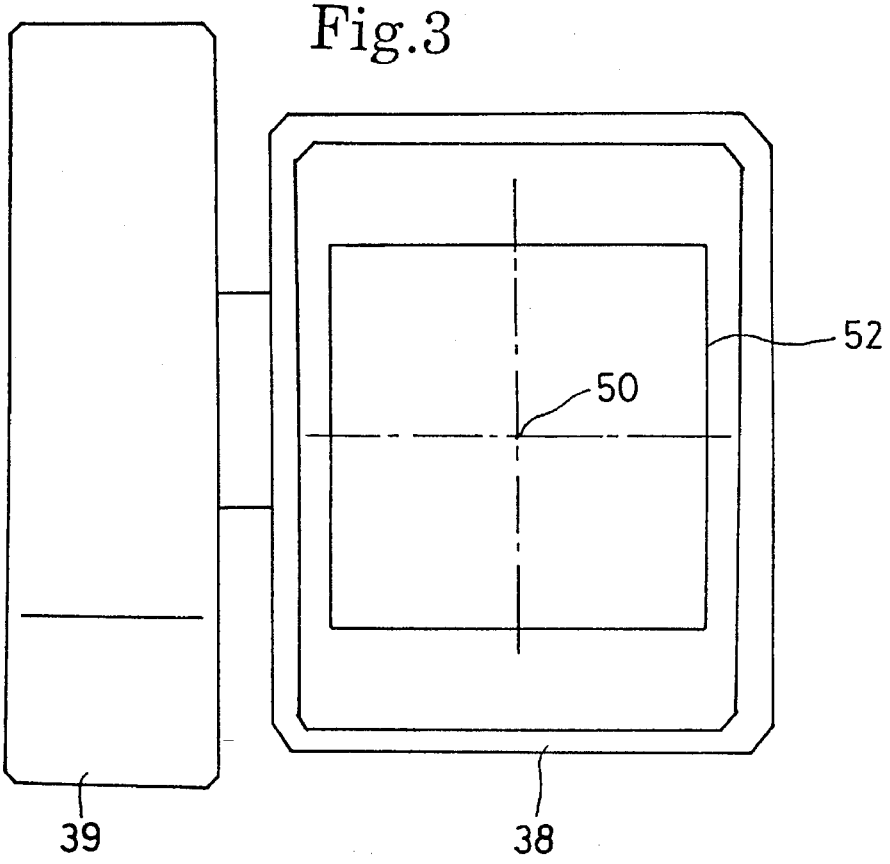
FIG. 3 is an enlarged plan view of an embroidery frame and an embroidery frame moving mechanism included in the embroidering machine of FIG. 1.
Figure 4A:
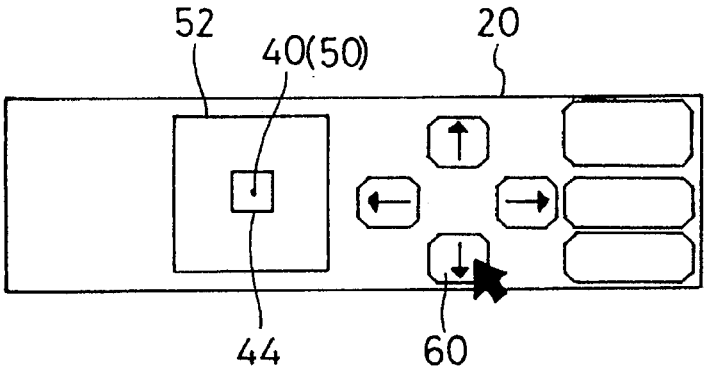
FIGS. 4A and 4B are enlarged plan views of the screen of a display unit included in the embroidering machine of FIG. 1.
Figure 4B:
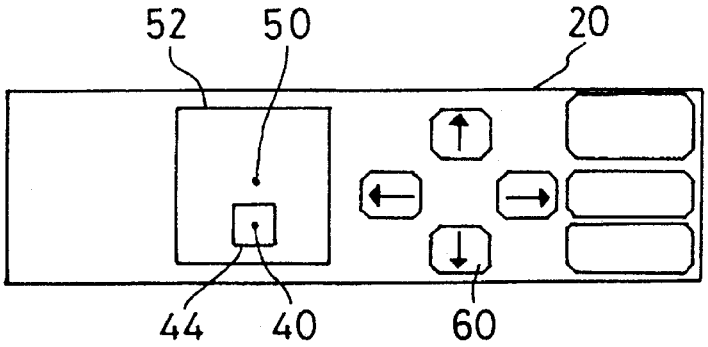
Figure 8:
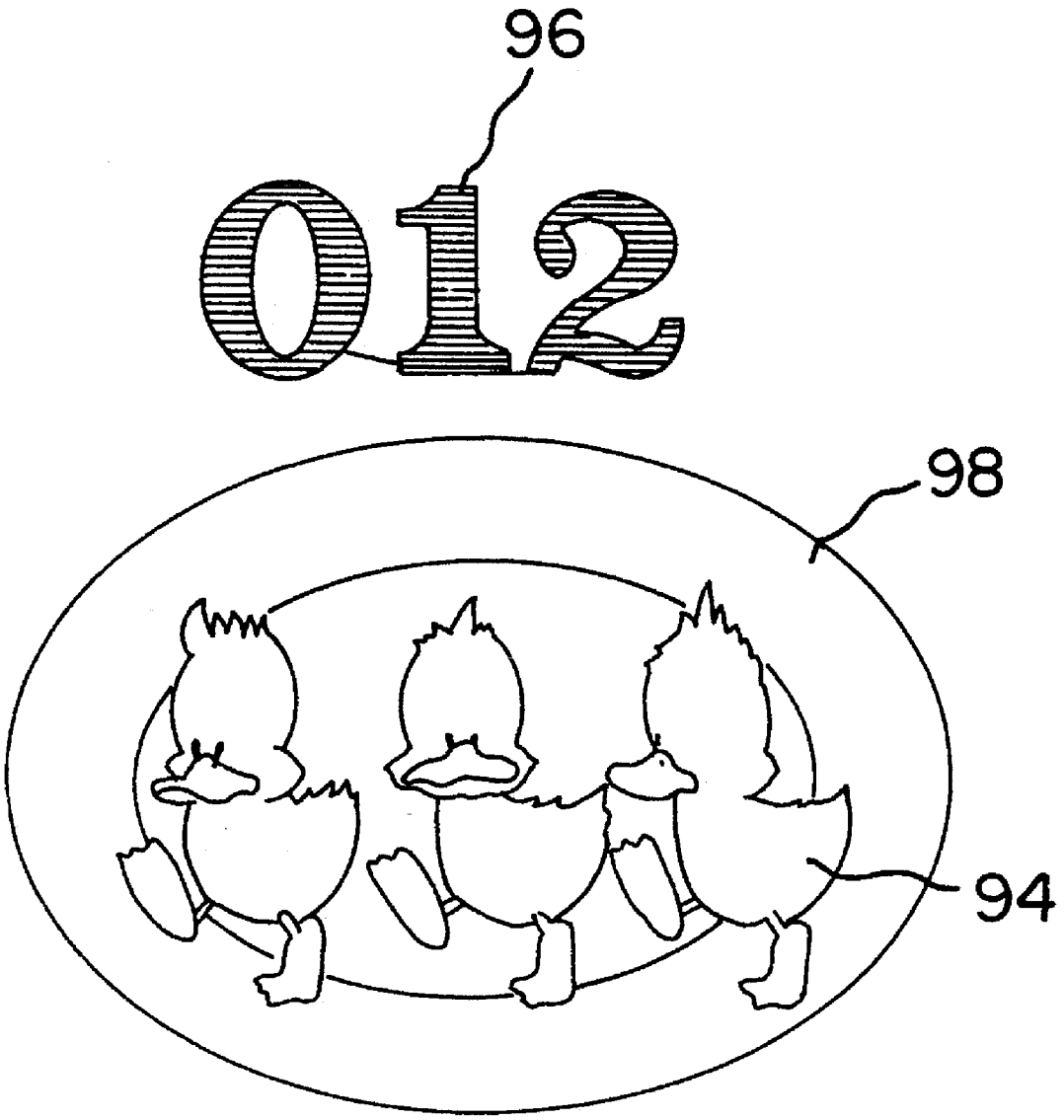
FIG. 8 is an illustration of a composite pattern embroidered by the sewing machine embodying the present invention.

The operation of the sewing machine for embroidering a composite pattern as shown in FIG. 8 consisting of the pictorial pattern 94, the character pattern 96 and the framing pattern 98 shown respectively in FIGS. 7A, 7B and 7C will be described hereinafter. The stitching data of the framing pattern 98 includes the data of the reference point of a pattern frame circumscribing the framing pattern 98 at the intersection point of the longitudinal and lateral center lines of the pattern frame as indicated by alternate long and short dash lines in FIG. 2. The reference point coincides with a position (relative to the workpiece) where the needle 32 is positioned before the sewing machine starts embroidering the framing pattern 98 on the workpiece. Similarly, the reference point for the pictorial pattern 94 and the character pattern 96 coincides with positions (relative to the workpiece) where the needle 32 is positioned before the sewing machine starts embroidering the pictorial pattern 94 and the character pattern 96, respectively. In order to superpose the patterns 94, 96 and 98 properly, the reference points for all three patterns are at the same position. Both the data of the character pattern 96 and that of the framing pattern 98 are stored in the same ROM card 80. The data of the pictorial pattern 94 is stored in another ROM card.

Figure 5:
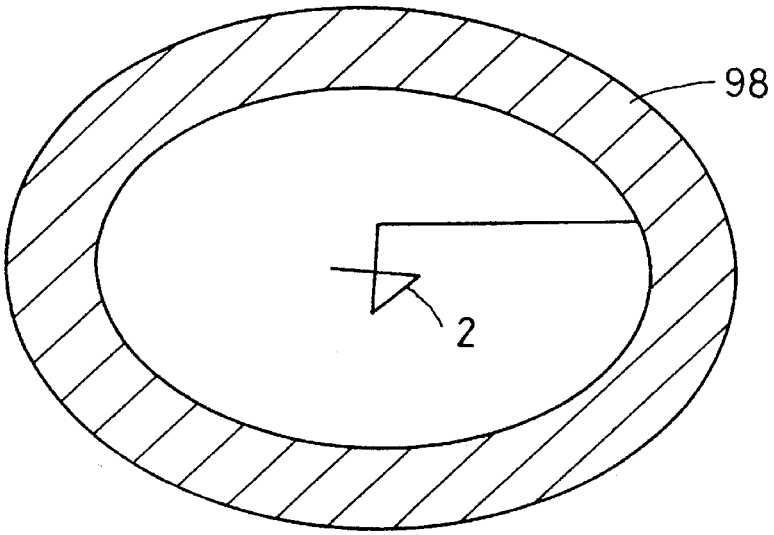
FIG. 5 is an illustration of a framing pattern.

The framing pattern 98 is selected, an embroidering area in the effective embroidering area 52 is specified, and then, the push button of the start-stop switch 26 is pushed to start the embroidering operation. As shown in FIG. 5, the framing pattern 98 including stitches 2 indicating the reference point is then stitched. One of the stitches 2 extends in parallel to the direction in which the arm 14 extends and the other stitch 2 extends across the former stitch 2 in a direction perpendicular to the former stitch 2 so as to form a cross. Then, the character pattern 96 is selected and the position of the character pattern 96 in the effective embroidering area 52 is specified. After the framing pattern 98 has been embroidered, the character pattern 96 is selected, the position of the character pattern 96 in the effective embroidering area 52 is specified, and then, the push button of the start-stop switch 26 is pushed to stitch the character pattern 96.

Then, the ROM card 80 storing the data of the character pattern 96 and that of the framing pattern 98 is removed from the sewing machine and the ROM card storing the pictorial pattern 94 is inserted in the sewing machine. Then, the operator selects the pictorial pattern 94 and specifies the position of the pictorial pattern 94 in the effective embroidering area 52 with reference to the stitches 2 indicating the reference point. Then, the push button of the start-stop switch 26 is operated to start stitching the pictorial pattern 94. Consequently, the composite pattern consisting of the pictorial pattern 94, the character pattern 96 and the framing pattern 98 as shown in FIG. 8 is completed. In FIG. 8, the stitches 2 indicating the reference point are omitted.

The stitches 2 perpendicularly intersecting each other in a cross facilitates the fine positional adjustment of the pictorial pattern 94 relative to the framing pattern 98. The stitches 2 may be removed after the completion of the composite pattern, to finish the composite pattern in a satisfactory appearance.

If the stitches 2 are small stitches and the thread extending from the stitches 2 is cut before stitching the pictorial pattern 94, the stitches 2 will be covered with the pictorial pattern 94 and hence the stitches 2 need not be removed after the completion of the composite pattern.

The present invention is not limited in its practical application to the foregoing embodiment specifically described herein. For example, the respective positions of the stitches 2 indicating the reference point may be determined by calculation according to a program stored in the machine instead of specifying the same by the data stored in the ROM card 80. In accordance with another preferred embodiment, the machine may include a storage memory which stores the location of the reference position of the embroidery frame (i.e., the position at which the needle 32 is directly above the reference point). In this embodiment, the embroidery frame automatically returns to the reference position in specific circumstances, e.g., after the power to the machine has been switched off and then switched back on. The machine may also include a key which can be pressed by an operator to cause the embroidery frame to be moved to its-reference position whenever desired. The storage memory may store more than one reference position, and a corresponding number of keys can be provided and/or the machine can automatically move the embroidery frame to a specific reference position in specific circumstances.

Stitches indicating a position where the needle 32 is stopped may be stitched before embroidering the framing pattern 98, regardless of the shape of the pattern. The stitches 2 indicating the reference point need not necessarily be stitched in connection with the framing pattern 98, but the same may be stitched individually for previously specifying the position of a pattern to be stitched later.

The mark indicating the reference point, the pictorial pattern 94, the character pattern 96 and the framing pattern 98 can be stitched in any desired order. Reference point stitching may be formed by any suitable pattern, e.g., by forming two or more stitches which intersect at the reference point, or by making a mark at a single point.

The controller in the present invention can comprise any apparatus which is capable of controlling a stitcher and a workpiece mover as described herein.

What is claimed is:

1. A sewing machine for stitching patterns on a workpiece, comprising:

a stitching means for forming stitches, said stitching means comprising a needle capable of vertical reciprocation;

a workpiece moving means for longitudinally and laterally moving a workpiece relative to said needle; and a control means for reading pattern data representing a stitching pattern and controlling said stitching means and said workpiece moving means to perform a stitching operation in which said stitching pattern is formed on said workpiece and a stitching operation in which a reference mark for said stitching pattern is formed on said workpiece at a position which indicates an initial position of said workpiece moving means.

2. The sewing machine according to claim 1, wherein said reference point is located at a mark on said workpiece which is directly below said needle when said stitching pattern is initiated.

3. The sewing machine according to claim 2, wherein said reference mark is formed by at least two stitches which intersect.

4. The sewing machine according to claim 2, wherein said reference mark is formed by at least two stitches which intersect and which are perpendicular.

5. The sewing machine according to claim 2, wherein said reference mark is positioned substantially at a center of said stitching pattern.

6. The sewing machine according to claim 2, wherein said control means includes storing means for storing data for at least one of plural stitching patterns and data for forming said reference mark.

7. The sewing machine according to claim 2, wherein said control means controls said stitching means and said workpiece moving means so that said reference mark is formed on said workpiece and then said stitching pattern is formed on said workpiece.

8. The sewing machine according to claim 1, wherein said reference mark is located at an intersection of a longitudinal center line and a lateral center line of a rectangular or square shape which circumscribes said stitching pattern.

9. The sewing machine according to claim 8, wherein said rectangular or square shape is of a minimum area required to circumscribe said stitching pattern.

10. The sewing machine according to claim 2, further comprising a switch which, when operated, causes said sewing machine to start stitching said stitching pattern, said reference point being located at a mark on said workpiece which is directly below said needle at a time (1) before a first stitch in said stitching pattern is stitched and (2) when said switch is operated to start stitching said stitching pattern.

11. A sewing machine comprising:

a stitcher;

a workpiece mover;

a controller which controls said stitcher and said workpiece mover for forming stitches according to a stitching pattern on a workpiece; and means for forming a reference mark which indicates an initial position of said workpiece mover.

12. The sewing machine according to claim 11, wherein said reference mark is located at a point on said workpiece which is directly below said needle when said stitching pattern is initiated.

13. The sewing machine according to claim 12, wherein said reference mark is formed by at least two stitches which intersect.

14. The sewing machine according to claim 12, wherein said reference mark is formed by at least two stitches which intersect and which are perpendicular.

15. The sewing machine according to claim 12, wherein said reference mark is positioned substantially at a center of said stitching pattern.

16. A method of sewing, comprising:

operating a workpiece mover and a stitcher, said stitcher comprising a needle, to form stitches on a workpiece according to pattern data of a first stitching pattern;

operating said workpiece mover and said stitcher to form a reference mark for said first stitching pattern on said workpiece, said reference mark being made at a position which indicates an initial position of said workpiece mover.

17. The method according to claim 16, wherein said reference point is located at a mark on said workpiece which is directly below said needle when said first stitching pattern is initiated.

18. The method according to claim 17, further comprising operating a switch to cause said sewing machine to start stitching said stitching pattern, said reference mark being located at a point on said workpiece which is directly below said needle at a time (1) before a first stitch in said stitching pattern is stitched and (2) when said switch is operated to start stitching said stitching pattern.

19. The method according to claim 17, wherein said reference mark is formed by stitching at least two stitches which intersect.

20. The method according to claim 17, wherein said reference mark is positioned substantially at a center of said first stitching pattern.

21. The method according to claim 17, wherein said reference mark is formed on said workpiece and then said first stitching pattern is formed on said workpiece.

22. The method according to claim 17, further comprising operating said workpiece mover and said stitcher to form stitches on said workpiece according to pattern data of a second stitching pattern, the reference mark for said first stitching pattern being the same as a reference mark for said second stitching pattern.

23. A data storage medium for use in combination with a sewing machine for stitching a pattern on a workpiece, the sewing machine comprising a stitching means having a needle capable of vertical reciprocation, a workpiece moving means for longitudinally and laterally moving the workpiece relative to said needle, and a control means for controlling said stitching means and said workpiece moving means; said data storage medium comprising stored data to be used by said control means for controlling said stitching means and said workpiece moving means, said stored data comprising pattern data representing a stitching pattern and data for forming a reference mark for said stitching pattern, said reference mark being located at a point on said workpiece which is directly below said needle when said stitching pattern is initiated.

24. The data storage medium according to claim 23, wherein said reference mark is located at an intersection of a longitudinal center line and a lateral center line of a rectangular or square shape which circumscribes said stitching pattern.

25. The data storage medium according to claim 24, wherein said rectangular or square shape is of a minimum area required to circumscribe said stitching pattern.

26. The sewing machine according to claim 6, wherein each of the data for plural stitching patterns is constructed so as to be superimposed suitably when the needle starts its movement to form each of said stitching patterns from a position where said reference mark is located directly below the needle.

* * * * *